United States Patent [19]

Farago

[11] Patent Number: 4,537,733

[45] Date of Patent: Aug. 27, 1985

[54] NONWOVEN FIBER-SHEET PROCESS

[75] Inventor: John Farago, Richmond, Va.

[73] Assignee: E. I. Du Pont de Nemours and Company, Wilmington, Del.

[21] Appl. No.: 547,384

[22] Filed: Oct. 31, 1983

[51] Int. Cl.[3] ..... B29C 6/00

[52] U.S. Cl. ..... 264/9; 264/10; 264/24; 264/40.7; 425/83.1; 425/174.8 E; 425/72 S

[58] Field of Search ..... 264/9, 10, 24, 40.7; 425/72 S, 83.1, 174.8 E

[56] References Cited

U.S. PATENT DOCUMENTS

| | | | |
|---|---|---|---|
| 2,736,676 | 2/1956 | Frickert, Jr. | 264/168 |
| 3,081,519 | 3/1963 | Blades et al. | 264/5 |
| 3,169,899 | 2/1965 | Steuber | 264/167 |
| 3,280,229 | 10/1966 | Simons | 264/24 |
| 3,319,309 | 5/1967 | Owens | 425/174.8 E |
| 3,387,326 | 6/1968 | Hollberg et al. | 264/24 |
| 3,402,227 | 9/1968 | Knee | 264/22 |
| 3,433,857 | 3/1969 | Dutton et al. | 264/24 |
| 3,490,115 | 1/1970 | Owens et al. | 264/24 |
| 3,497,918 | 3/1970 | Pollock, Jr. et al. | 425/324.1 |
| 3,546,898 | 12/1970 | Langlois et al. | 264/9 |
| 3,565,979 | 2/1971 | Palmer | 264/24 |
| 3,578,739 | 5/1971 | George | 425/725 |
| 3,593,074 | 7/1971 | Isakoff | 264/24 |
| 3,689,608 | 9/1972 | Hollberg et al. | 264/121 |
| 3,860,369 | 1/1975 | Brethauer et al. | 264/22 |
| 4,148,595 | 4/1979 | Bednarz | 264/22 |
| 4,223,101 | 9/1980 | Fine et al. | 264/24 |

FOREIGN PATENT DOCUMENTS

| | | | |
|---|---|---|---|
| 2468678 | 5/1981 | France | 264/24 |

*Primary Examiner*—Jeffery Thurlow
*Assistant Examiner*—Patrick Dailey

[57] ABSTRACT

A process is provided for reducing the size and number of undesirable gauge bands in wound-up rolls of wide nonwoven sheet that is produced by a plurality of oscillating fiber streams depositing fiber on a moving receiver. The desired effect is accomplished by varying the oscillation frequency of the fiber streams by more than ±5% of the average oscillation frequency.

4 Claims, 4 Drawing Figures

NONWOVEN FIBER-SHEET PROCESS

BACKGROUND OF THE INVENTION

1. Field of the Invention

This invention relates to a nonwoven-sheet-making process in which each of a plurality of fiber streams is oscillated as it is forwarded to a moving receiver on which it deposits its fibers to form a ribbon which combines with ribbons formed by other streams. In particular, the invention concerns an improved process in which the oscillation frequency of the fiber stream is varied to provide an improvement in the uniformity of the resultant sheet.

2. Description of the Prior Art

Many processes are known wherein fibers from a plurality of positions are deposited and intermingled on the surface of a moving receiver to form a wide nonwoven sheet. For example, Knee, U.S. Pat. No. 3,402,227, discloses a plurality of jets positioned above a receiver and spaced in a line that makes an angle with the direction of receiver movement so that the fiber streams that issue from the jets deposit fibers on discrete areas of the receiver to form ribbons which combine with ribbons formed from other streams along the line. Also, several methods are known for directing the fibers from a plurality of positions to various locations across the width of the receiver. Frickert, U.S. Pat. No. 2,736,676, for example, discloses directing glass fibers to a receiver by means of a wobble plate or by means of a cylinder which rotates about an axis that is canted at a small angle to the longitudinal axis of the cylinder. Steuber, U.S. Pat. No. 3,169,899, discloses the use of curved oscillating baffles for spreading flash-spun plexifilamentary strands while oscillating and directing them to a moving receiver. Processes for flash-spinning the plexifilamentary strand are disclosed in Blades and White, U.S. Pat. No. 3,081,519.

An efficient method for depositing fibers onto the surface of a moving receiver is disclosed in Pollock and Smith, U.S. Pat. No. 3,497,918. In a preferred embodiment of Pollock and Smith, plexifilamentary strand is flash-spun and forwarded in a generally horizontal direction into contact with the surface of a rotating lobed baffle. The baffle deflects the strand and accompanying expanded solvent gas downward into a generally vertical plane. Simultaneously, the baffle spreads the strand into a wide, thin web and causes the web to oscillate as it descends toward the receiver surface. An electrostatic charge is imparted to the web during its descent to the receiver. The web is then deposited as a wide swath on the surface of the receiver. To make wide sheet, numerous flash-spinning units of this type are employed. The units are positioned above the moving receiver surface so that the deposited swaths form ribbons which partially overlap and combine to form a multi-layered sheet.

Multi-position apparatus of the type disclosed in Pollock and Smith has been very useful in commercial production of wide nonwoven sheets prepared from flash-spun plexifilamentary strands. In the past, such apparatus has been operated with all of the baffles rotating at substantially the same constant speed. However, such operation was sometimes accompanied by the formation of lanes of high and low unit weight or thickness in the sheet. These lanes through hardly measurable on one layer of sheet, became visible as "gauge bands" in rolls of the sheet, wherein many layers of sheet are wound up, one atop the other. The gauge bands, in turn, apparently caused uneven or telescoped edges of the roll. Because of compressive forces exerted by the wound-up sheet, the lanes of higher unit weight or thickness became denser than other parts of the sheet in the roll. Subsequently, such differences in density often led to nonuniformities in printing or dyeing of the sheet.

The purpose of the present invention is to eliminate or at least significantly reduce the formation of deleterious gauge bands in nonwoven fiber sheet.

SUMMARY OF THE INVENTION

The present invention provides an improved process for making a wide nonwoven fiber sheet. The process is of the general type wherein a fiber stream issues from each of a plurality of positions located above a moving receiver along a line that makes an angle with the direction of receiver movement, each fiber stream being oscillated as it is forwarded to the receiver whereon it deposits fibers to form a ribbon which is lapped with ribbons from preceding and succeeding positions along the line. The improvement of the present invention comprises varying the oscillation frequency of every other fiber stream along the line by more than $\pm 5\%$, but less than $\pm 50\%$, of the average oscillation frequency of the stream, the variation in oscillation frequency having a period in the range of 1 to 120 seconds. Preferably the variation in oscillation frequency is in the range of $\pm 10$ to $\pm 20\%$ and the period of the variation in oscillation frequency preferably is in the range of 10 to 60 seconds. Generally, the average oscillation frequency is in the range of 25 to 150 cycles per second. It is also preferred that the variations in oscillation frequency for successive fiber streams in the line be 180 degrees out of phase with each other. In a particularly preferred embodiment of the invention, each stream of fibers comprises a plexifilamentary strand of polyethylene polymer and a rotating lobed baffle provides the oscillation to the stream.

BRIEF DESCRIPTION OF THE DRAWINGS

The invention will be further understood by reference to the attached drawings in which.

DETAILED DESCRIPTION OF PREFERRED EMBODIMENTS

Although the invention will now be described and illustrated in detail with respect to a preferred process for manufacturing wide nonwoven sheets from flash-spun plexifilamentary strands of polyethylene, the invention is considerably broader in its application and can be used in a large variety of sheet making processes, such as those described and referred to earlier in the "Description of the Prior Art."

As used herein, the term "fiber" is intended to include filaments, fibrous strands, plexifilaments, staple fibers and the like. The fibers usually are of organic polymers, but inorganic fibers, such as glass, are also suitable for use in the invention.

Figure 3:
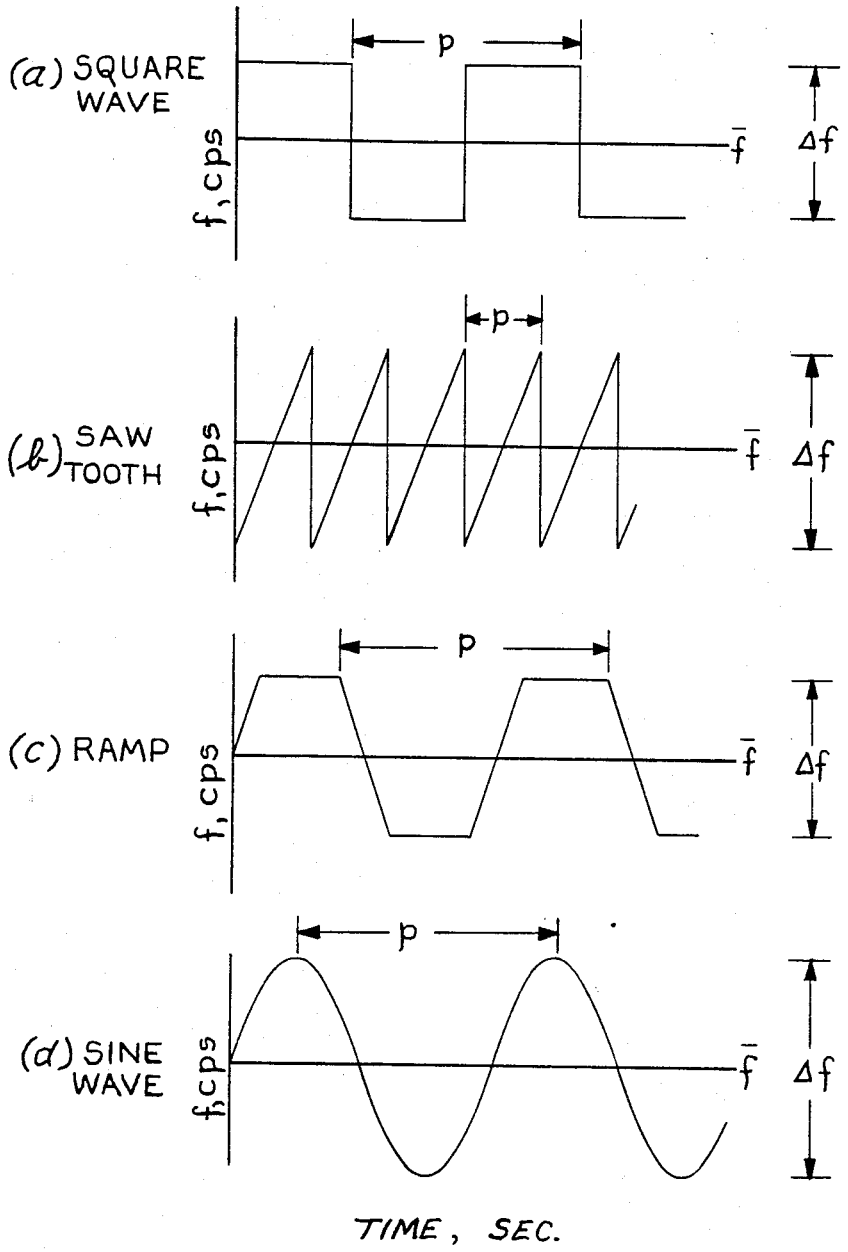
FIG. 3 displays graphs of oscillation frequency versus time and illustrates several types of variations that can be imposed upon the oscillation frequency of the fiber stream.
Figure 4:
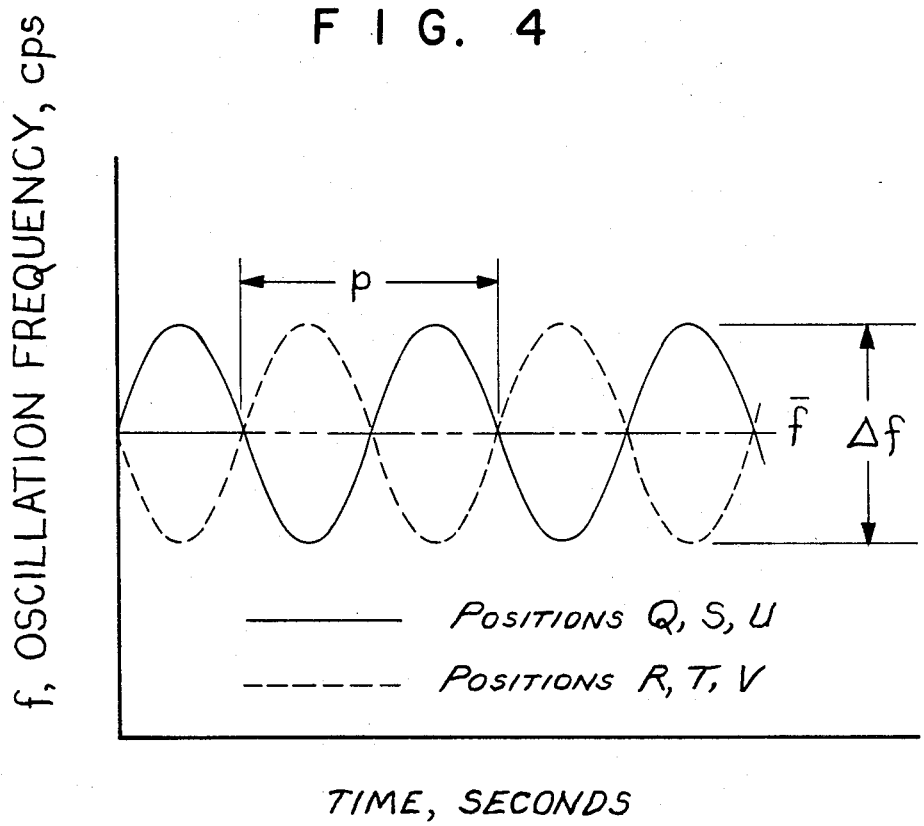
FIG. 4 illustrates a preferred method for varying stream oscillation frequency in successive fiber-handling positions of a multi-position nonwoven-sheet-making machine.

To further aid in understanding the invention, several terms and symbols concerning the fiber-stream oscillation are used herein. The instantaneous oscillation frequency, f, is the rate at which the fiber stream is oscillating at any given moment, i.e., the number of times per second that the fiber stream moves from one extreme of its area of fiber deposition to the other extreme and back. The average oscillation frequency is designated $\bar{f}$. In varying the oscillation frequency according to the invention, a range of frequencies is imposed. The range is designated $\Delta f$ and equals the difference between the maximum and minimum imposed oscillation frequencies. The variation in oscillation frequency is designated V and is expressed as a plus or minus percentage of the average oscillation frequency (i.e., $V=\pm 100(\Delta f/2\bar{f})$. The period of the imposed variation in oscillation frequency is designated p and equals the time for the imposed variation to proceed from its maximum frequency to its minimum frequency and back to its maximum frequency, i.e., the time required for one complete variation cycle. The meaning of these terms is illustrated in FIGS. 3 and 4.

Figure 1:
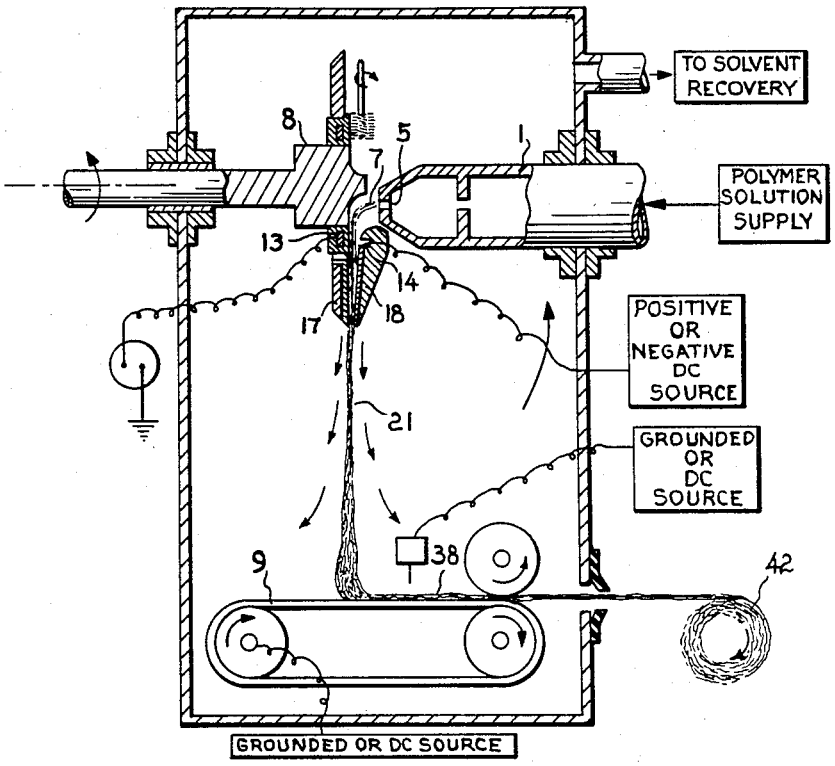
FIG. 1 is a schematic cross-sectional view of one position of a flash-extrusion apparatus that can be used for making nonwoven sheet.

An apparatus that is particularly suited for use in the improved process of the present invention is a flash-extrusion apparatus of the type disclosed in FIG. 1 of Bednarz, U.S. Pat. No. 4,148,595. As shown in that patent and in FIG. 1 herein, such a typical position generally includes a spinneret device 1, having an orifice 5, positioned opposite a rotating baffle 8, an aerodynamic shield comprised of members 13, 14, 17, and 18 located below the baffle and including corona discharge needles 14 and target plate 13, and a moving receiver surface 9 below the aerodynamic shield. A more detailed description of the apparatus is found in Bednarz at column 1, lines 67 through column 2, lines 64 and in Brethauer and Prideaux, U.S. Pat. No. 3,860,369 at column 3, line 41 through column 4, line 63, which descriptions are incorporated herein by reference. The rotating baffle 8 is lobed in accordance with the disclosure of Pollock and Smith, U.S. Pat. No. 3,497,918, the entire disclosure of which is incorporated herein by reference.

In operation of equipment of the type depicted in FIG. 1, a polymer solution is fed to spinneret device 1. Upon exit from orifice 5, the solvent from the polymer solution is rapidly vaporized and a plexifilamentary strand 7 is formed. Strand 7 advances in a generally horizontal direction to the rotating baffle 8 which deflects strand 7 downward into a generally vertical plane and through the passage in the aerodynamic shield. The rotating baffle, the action of the solvent gas and the effects of passage through the corona discharge field and the aerodynamic shield spread the strand into a thin, wide web 21 which is deposited on a moving receiver 9. The lobes of rotating baffle 8 impart an oscillation to plexifilamentary strand 7 so that the spread and deflected strand oscillates as it descends to the moving receiver. On receiver 9, the plexifilamentary web is deposited as a swath, which forms a ribbon that is combined with ribbons from other positions (not shown) to form wide sheet 38, which is then wound up as roll 42. The direction of oscillation of the descending strand is in the vertical plane that is perpendicular to the plane of the paper. Note that the width of the oscillating strand as it reaches the receiver is usually significantly narrower than the width of the ribbon that forms on the receiver surface. For example, a 40-cm wide spread web, because of the oscillation imparted to it by the rotating lobed baffle could form a ribbon that is more than 60-cm wide.

Figure 2:
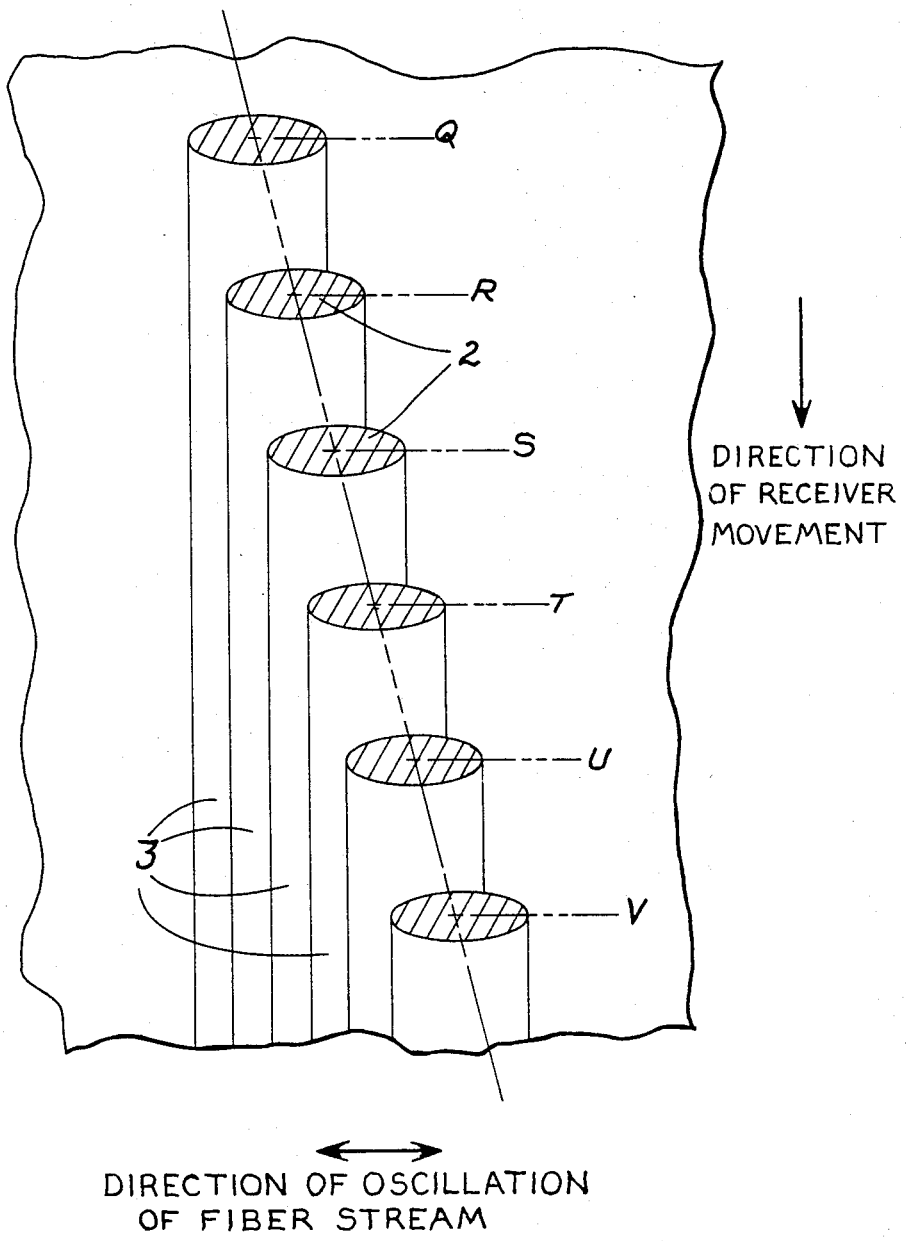
FIG. 2 is a schematic plan view of successive areas of fiber deposition on a portion of a moving receiver which is located below a series of fiber-handling positions arranged along a line that is at an acute angle to the direction of receiver movement.

A convenient and preferred method is shown schematically in FIG. 2 for arranging a plurality of flash-extrusion positions of the above-described type above a moving receiver so that the deposited swaths form ribbons which are combined to form a wide sheet on the receiver. FIG. 2 shows the swaths formed on a moving receiver by six successive fiber streams emerging from positions labelled Q, R, S, T, U, and V. The direction of movement of the receiver is indicated by the arrow on the right-hand side of the diagram. The consecutive positions are arranged in a line that is at an acute angle to the direction of movement of the receiver. The shaded area at each position, designated 2, represents the area on the receiver surface on which that position deposits fibers to form a swath. As the receiver moves, the swath forms a ribbon which partially overlaps the ribbon from a preceding position in the line and is partially overlapped by the ribbon from the next succeeding position in the line. Thus as shown in FIG. 2, the ribbon formed by position S overlaps the ribbon from position R and is overlapped by the ribbon from position T. The width of the individual ribbons and the angle made by the line of positions with the direction of movement of the receiver, determine the percentage of each ribbon that is overlapped by the succeeding ribbons. In FIG. 2 the portion of the ribbon that is not overlapped by the preceding position is designated 3. As illustrated in FIG. 2, each ribbon is overlapped approximately 75% by the ribbon being formed in the succeeding position. As a result of the overlapping, the thickness of the formed sheet typically is made up of four overlapped layers. Other arrangements of the fiber-depositing positions are also suitable for making wide sheet, such as those disclosed in Knee, U.S. Pat. No. 3,402,227.

It has been conventional practice to operate the above-described type of multi-position sheet-making equipment with all fiber streams (except perhaps for those near the edge of the sheet) being oscillated at the same constant frequency. This was deemed necessary to produce uniform sheet. However, even under such operating conditions, as pointed out earlier, gauge bands were encountered in rolls of wound-up sheet.

In practicing the present invention with rotating lobed baffles in the multiple positions of a machine making sheet from flash-spun plexifilaments of polyethylene film-fibrils, the average oscillation frequency is usually in the range of 25 to 150 cycles per second (cps), but is preferably in the range of 50 to 100 cps. The variation in oscillation frequency is controlled so that it is usually more than ±5% and less than ±50%. When the variation is ±5% or less, the improvement in reducing the size and number of gauge bands is not evident but, when the variation is increased to ±10%, the improvement increases significantly. A variation in the range of ±10 to ±20% usually provides the greatest improvement. Although variations in oscillation frequency of more than ±50% may ameliorate the gauge band problem, such large variations are unnecessary and from the practical viewpoint of equipment cost, less desirable.

In accordance with the present invention, a wide variety of variations in oscillation frequency with time may be used. Examples of several such variations are shown in FIG. 3 which depicts (a) a square-wave variation, (b) a sawtooth variation, (c) ramp variation and (d) a sine wave variation. Many others also are suitable.

The period, p, of the variation in oscillation frequency may be selected from a wide range of values. Usually, periods in the range of about 1 to 120 seconds are satisfactory. Periods of 10 to 60 seconds are preferred.

It is not necessary to vary the oscillation frequency of all fiber streams in the line of multiple positions above the receiver. Sometimes, it is sufficient to vary the oscillation frequency of every other fiber stream in the line. However, for greater effectiveness in eliminating or at least reducing the size of gauge bands in wound-up sheet, it is preferred to vary the oscillation frequency in a regular manner. A preferred method is to vary the oscillation frequency of the streams so that the variation for each successive position along the line of multiple positions is out of phase with that of the preceding position.

A preferred method of varying the oscillation frequency of the fiber streams of the multiple positions of the type illustrated in FIG. 2, is shown in FIG. 4. As shown in FIG. 4, a preferred sinusoidal variation in oscillation frequency is being imposed on the fiber streams and the variation in each successive position is 180 degrees out of phase with the variation in the preceding position. The sinusoidal variation is particularly preferred because it is easily controlled automatically and it avoids abrupt changes in oscillation frequency that can cause excessive equipment wear.

In the example below, the invention is applied to the manufacture of wide, nonwoven sheets made from flash-spun plexifilaments of polyethylene film fibrils. Gauge bands are detected by placing a T-square or a flat steel ruler on the surface of a roll of wound-up sheet. A typical undesirable gauge band manifests itself as an indentation of about ¼-inch (0.63-cm) depth in a roll of about one-meter diameter. In the example, the oscillation frequency of the streams was varied by varying the speed of rotation of the lobed baffles of the flash-spinning positions. The baffles were driven by synchronous motors whose speed could be controlled manually or automatically.

EXAMPLE

The tests described in this example demonstrate the reduction of gauge bands by use of the present invention. Nonwoven sheets of flash-spun plexifilaments of polyethylene film fibrils were made and wound up into one-meter diameter rolls by the general method described above with reference to FIGS. 1 and 2.

In the first test, the oscillation frequency of the fiber stream from every other position (excluding edge positions) was varied simultaneously, while the oscillation frequency of the remaining positions was held constant. Three test rolls of 2.2 oz/yd$^2$ (75 g/m$^2$) sheet were produced in accordance with the invention. The average oscillation frequency in each of the fiber streams that was not varied was 60 cycles per second (cps). For the fiber streams whose oscillation frequency was varied, the frequency was repetitively, in sequence, held at 60 cps for 25 seconds, rapidly increased to 89 cps, held at 89 cps for 25 seconds and rapidly decreased to 60 cps, throughout the time that test rolls were being wound up. Thus, for fiber streams wherein the oscillation was varied, the average oscillation frequency was 74 cps, the range of oscillation frequencies was 29 cps and the variation in oscillation frequency was about ±19%. This variation of oscillation frequency with time approximated a square-wave variation, as illustrated in FIG. 3(*a*). The first of the three rolls made in accordance with the invention had two gauge bands. The second and third test rolls had no gauge bands. In contrast, the rolls made immediately before and after the test rolls, with all fiber streams oscillating at the same constant frequency of 60 cps, had 4 to 6 gauge bands.

In a second series of tests in which 1.25 oz/yd$^2$ (42 g/m$^2$) sheet was produced, oscillation frequency of all fiber streams was automatically controlled. The average oscillation frequency in all positions (excluding edge positions) was 71 cps. A ±10% variation in oscillation frequency was imposed on each fiber stream. The change in oscillation frequency in each succeeding position lagged the preceding position by 10 seconds, which was equivalent to being 180 degrees out of phase. Thus, one group of fiber streams consisting of the fiber streams from every other position had its oscillation frequency set at 63 cps while the remaining group of streams had its oscillation frequency set at 78 cps. Thus every 10 seconds, the frequencies would be changed, repetitively, from 63 to 78 and 78 to 63 cps. Control rolls made with all positions oscillating streams at 71 cps immediately before the test, had 7 to 9 deep gauge bands. After the test was started, the first eight test rolls had only 5 to 6 shallow gauge bands and the next seven test rolls had only 1 or 2 very shallow gauge bands. When the conditions were returned to pre-test operating conditions, the number of gauge bands per roll immediately returned to the 7 to 9 level.

Additional tests similar to the preceding test were run with the fiber-stream oscillation frequency being varied repetitively on a 52 second period, from 60 to 72 cps in 10 seconds, held at 72 cps for 16 seconds, returned to 60 cps in 10 seconds and held at 60 cps for 16 seconds. This variation provided a ramp variation as illustrated in FIG. 3(*c*) and roughly approximated a modified sine wave variation. As in the preceding tests, gauge bands in the test rolls were considerably fewer and shallower than those in control rolls made with all streams oscillating at the same constant average frequency.

What is claimed is:

1. In a process for making a wide nonwoven fiber sheet wherein a fiber stream issues from each of a plurality of positions located above a moving receiver and along a line that makes an angle with the direction of receiver movement, each fiber stream being oscillated as it is forwarded to the receiver whereon it deposits fiber to form a ribbon which is lapped with ribbons from preceding and succeeding positions along the line, the improvement comprising varying the oscillation frequency of every other fiber stream along the line by more than ±5%, but less than ±50%, of the average oscillation frequency, the variation in oscillation frequency having a period in the range of 1 to 120 seconds.

2. A process of claim 1 wherein the variation in oscillation frequency is in the range of ±10 to ±20% and the period is in the range of 10 to 60 seconds.

3. A process of claim 1 wherein each fiber stream comprises a plexifilamentary strand of polyethylene polymer and is oscillated by a rotating lobed baffle at an average frequency of 25 to 150 cycles per second.

4. A process of claim 1, 2 or 3 wherein the variation in oscillation frequency is imposed on all fiber streams and the variation for successive fiber streams in the line are about 180 degrees out of phase with each other.

* * * * *